US007465891B2

(12) United States Patent
Wolbarst

(10) Patent No.: US 7,465,891 B2
(45) Date of Patent: Dec. 16, 2008

(54) IN-LINE LOCKABLE ELECTRICAL SWITCH

(76) Inventor: Anthony Brinton Wolbarst, 150 Brushy Run Rd., Versailles, KY (US) 40383

( * ) Notice: Subject to any disclaimer, the term of this patent is extended or adjusted under 35 U.S.C. 154(b) by 166 days.

(21) Appl. No.: 11/701,905

(22) Filed: Feb. 2, 2007

(65) Prior Publication Data

US 2008/0185268 A1 Aug. 7, 2008

(51) Int. Cl.
*H01H 9/28* (2006.01)

(52) U.S. Cl. ..... 200/43.14; 200/334

(58) Field of Classification Search ..... 200/43.14
See application file for complete search history.

(56) References Cited

U.S. PATENT DOCUMENTS 3,312,799 A 4/1967 Reiter
4,166,202 A 8/1979 Reiter
4,389,550 A 6/1983 Reiter
4,654,487 A 3/1987 Sawada
5,577,600 A 11/1996 Schoene
6,805,208 B2 10/2004 Kusmierski

*Primary Examiner*—Michael A Friedhofer
*Assistant Examiner*—Lisa N Klaus

(57) ABSTRACT

An electric switch which can be locked using any possible lock to either prevent or ensure the flow of electric power to an electrical apparatus. The switch has a toggle-handle that a bar from a lock can be fitted into and immobilize the toggle-contactor, preventing the toggle from being moved. Thus the switch is prevented from being turned on or turned off. The switch is intended to be placed into a power cord and can be sold with a device or added later.

21 Claims, 3 Drawing Sheets

IN-LINE LOCKABLE ELECTRICAL SWITCH

CROSS-REFERENCE TO RELATED APPLICATIONS

None

FEDERALLY SPONSORED RESEARCH

None

SEQUENCE LISTING OR PROGRAM

None

FIELD OF INVENTION

This invention relates to electrical switches. More specifically it relates to lockable electrical switches. Even more specifically it relates to lockable electrical switches which can be installed into an existing product.

BACKGROUND OF THE INVENTION

A number of patents have been filed for safety devices for power tools that can lock the power switch so that the power tool is rendered inoperable. Most of these involve a physical barrier to turning on the power tool, but generally do not involve an actual lock that can prevent the power tool from being operated without unlocking the lock.

The U.S. Pat. Nos. 4,166,202 and 4,389,550, both by Reiter, are examples of safety switches that do use a lock to prevent the operation of a power tool. Patent '202 describes a system that can lock a power switch using a key. Once locked, the power switch cannot turn on the power tool, but an emergency button can turn the power tool off if it is already on. Patent '550 also is a similar system that uses a key lock to prevent the operation of the power switch. Patent '550 also has an emergency button that can turn off the power tool even when the switch is locked. The '550 also can be placed in the cord of the power tool to prevent operation. In both patents, the key lock is integrated into the housing for the switch and the housing is required to have an emergency off button.

While the '202 and '550 are useful, they are limited by the complex parts of each switch and housing, by the required emergency off button, and by the specific integrated lock. Both patents require that the lock is a key lock that operates by rotating a cam out of the path of the power switch. In fact, in both patents, the lock only works if it can block the path of the switch. The lock does not actually secure the switch or the toggle for the switch.

SUMMARY OF INVENTION

The purpose of the invention is to create a universal means, a lockable electrical switch (hereafter called "the device" or "the invention"), that can be used in all cases by all people, for controlling the use of an electrical apparatus (hereafter called an "apparatus") powered or activated by the standard two-phase or three-phase alternating current (A.C.) electric power source commonly used in homes, offices, factories, and elsewhere. The preferred embodiment is as a parental control device, but other applications as a security and safety device are possible.

Many sorts of switches exist to allow parents or others to control access to a computer, television, or any other electrical apparatus. Most of these switches are integrated into the functioning of the apparatus, and they generally limit access to some, but not all of its functions. Furthermore, they normally must be purchased with the apparatus, and older models do not have these features.

This invention allows one to control whether an electrical apparatus can be turned on or off. Rather than rely on complicated functions or controls, this invention creates a lockable switch that interrupts the flow of electric power from the wall receptacle to the apparatus.

The invention is simple to operate, so that parents and others will be able to control access to the apparatus without frustration. This avoids a problem with existing parental control devices: some are complex, and a child may better understand how to operate them than do the parents. Furthermore, the simplicity of the invention allows it to resist malfunction to a greater degree than more complicated devices.

The invention can be sold as a kit or unit that can be installed easily for an existing electrical apparatus, simply by insertion into the power cable. The invention can also be sold as a kit where a purchaser supplies his or her own lock that fits a specific need.

The essential application of the device is to provide a means to prevent unauthorized access to electrical equipment. Thus a computer can be secured by preventing any person without a key to the lock from using the computer. Alternatively, the invention could be used to prevent use of dangerous machinery, such as a saw powered by A.C. power from the wall, by allowing only a person with the key to the lock to use the apparatus. In this way the invention can also be a safety device.

This invention is an electrical switch that can be locked in either an "on" or an "off" position. The switch is attached to one of the wires within the main electrical power cord in such a manner that the switch can interrupt the circuit that the cord is part of.

A very simple form of the device is shown in FIGS. 1, 2, and 3. This particular version of the device is shown to illustrate the principle of operation, and much more sophisticated switching and locking mechanisms can easily be imagined. The toggle-handle for the mechanical switch has two holes, and is connected to the toggle-contactor. The hollow housing for the switch, seen alone in FIG. 2, also has a hole in it that lines up with one or the other hole in the toggle-handle. The lock-bar of a padlock or other form of lock can be placed through both the hole in the housing and one of the two holes in the toggle-contactor, thereby rendering the toggle unmovable and fixed in an "on" or "off" position. The lock can be either separate or integral to the switch.

The device can be of any type that can allows a switch to be locked temporarily in an "off" or an "on" position. The one shown in the drawings involves a simple mechanical padlock or combination lock, in which a lock-bar can fit into the holes in the casing and toggle and fixed in place. The lock can also be an electrical lock, in which case it could be controlled remotely, by way of a keypad or radio, or by other electronic means. The switch could also be controlled by specific sound or ultrasound patterns, optical or ultraviolet or infrared energy, or analogous means.

BRIEF DESCRIPTION OF THE DRAWINGS

The accompanying drawings, which are incorporated in and form part of the specification, illustrate the embodiments of the present invention and, together with the description, serve to explain the principles of the invention.

DETAILED DESCRIPTION OF THE DRAWINGS

Figure 1:
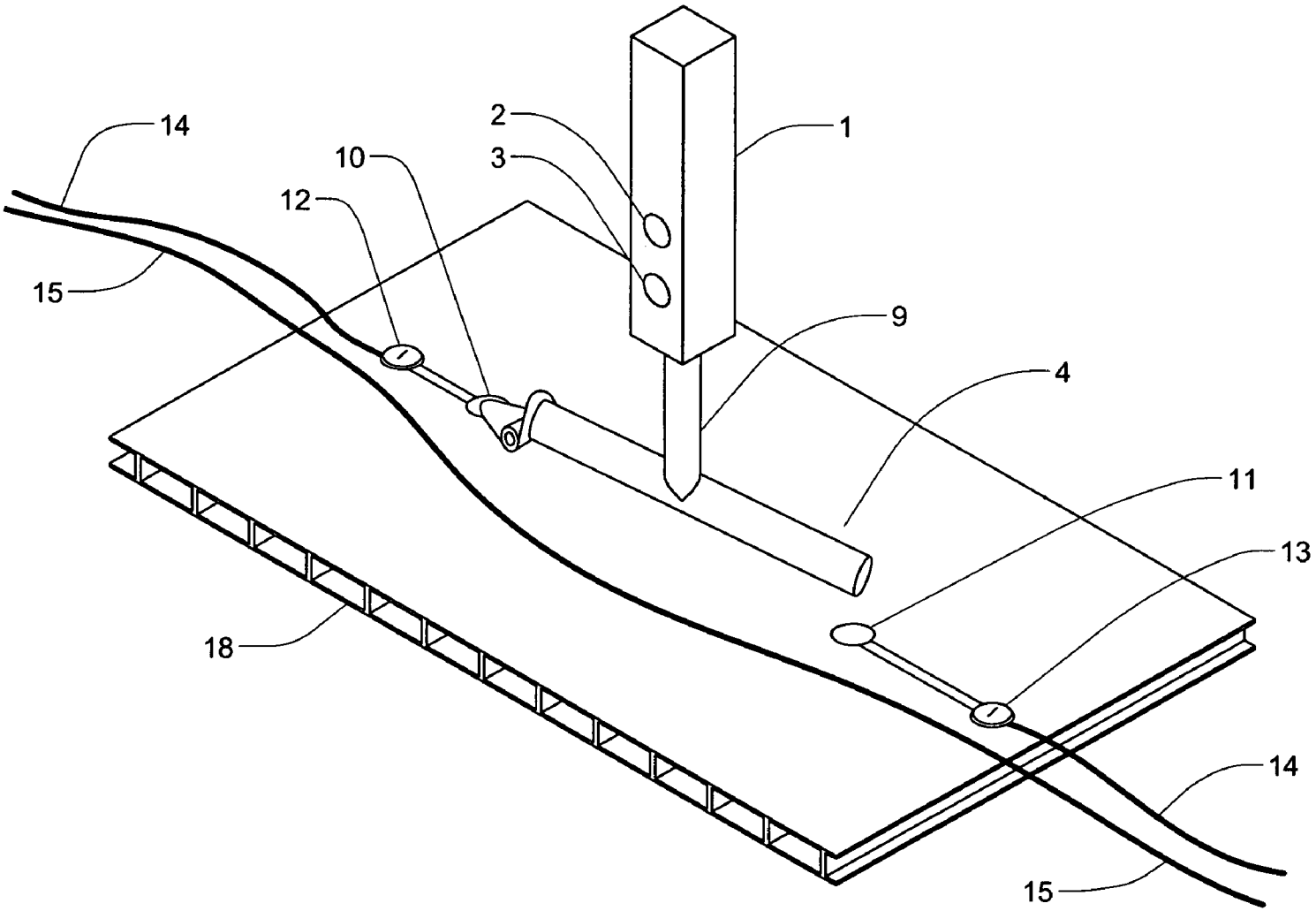
FIG. 1 is a picture of inner mechanism of the switch.

FIG. 1 illustrates the inner mechanism of the switch. The rigid toggle-handle 1 is attached to the conducting toggle-contactor 4 by means of a rigid, non-conducting connector 9. The toggle-contactor 4 has a conducting hinge 10 that allows the toggle-contactor 4 to move, so that it either touches or does not touch a metal contact 11. When the toggle-contactor 4 is touching the contact 11, the switch is "closed", providing electrical continuity between the two. When the switch is moved to the "open" configuration, in which the toggle-contactor does not touch the contact 11, electric current cannot flow, and the apparatus is not operational. The toggle-contactor 4 can be attached to a piece of electrical wire by means of a wire-connector 12, and the contact can be attached to another wire by means of another wire-connector 13.

Electric energy is applied to the apparatus by means of a pair of power-conducting wire 14 and power-conducting wire 15. In putting the invention in place, one of the two power wires for two-phase feeding the apparatus 14 is cut in two, and each free end is then attached to its corresponding wire-fastener 12 or corresponding wire-fastener 13. The other power wire for the apparatus 15 passes through the device undisturbed.

Figure 2:
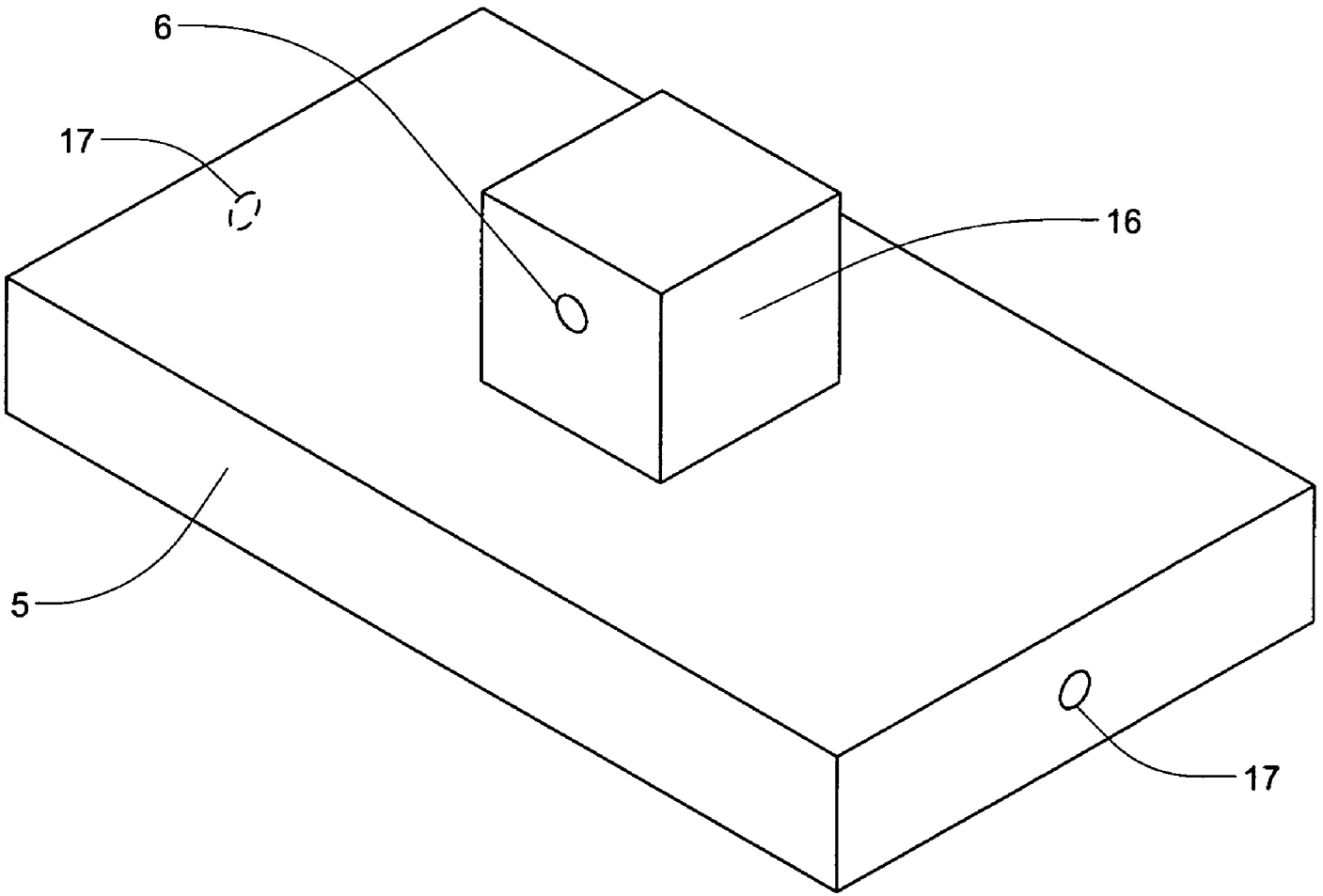
FIG. 2 is a picture of the casing.

FIG. 2 illustrates the casing 5. This provides a housing/guide 16 for mechanical motion for the toggle-handle 1, and it also has a lock hole 6. Both ends of casing 5 have holes 17 through which the pair of power wires 14 and 15 for the apparatus pass.

Figure 3:
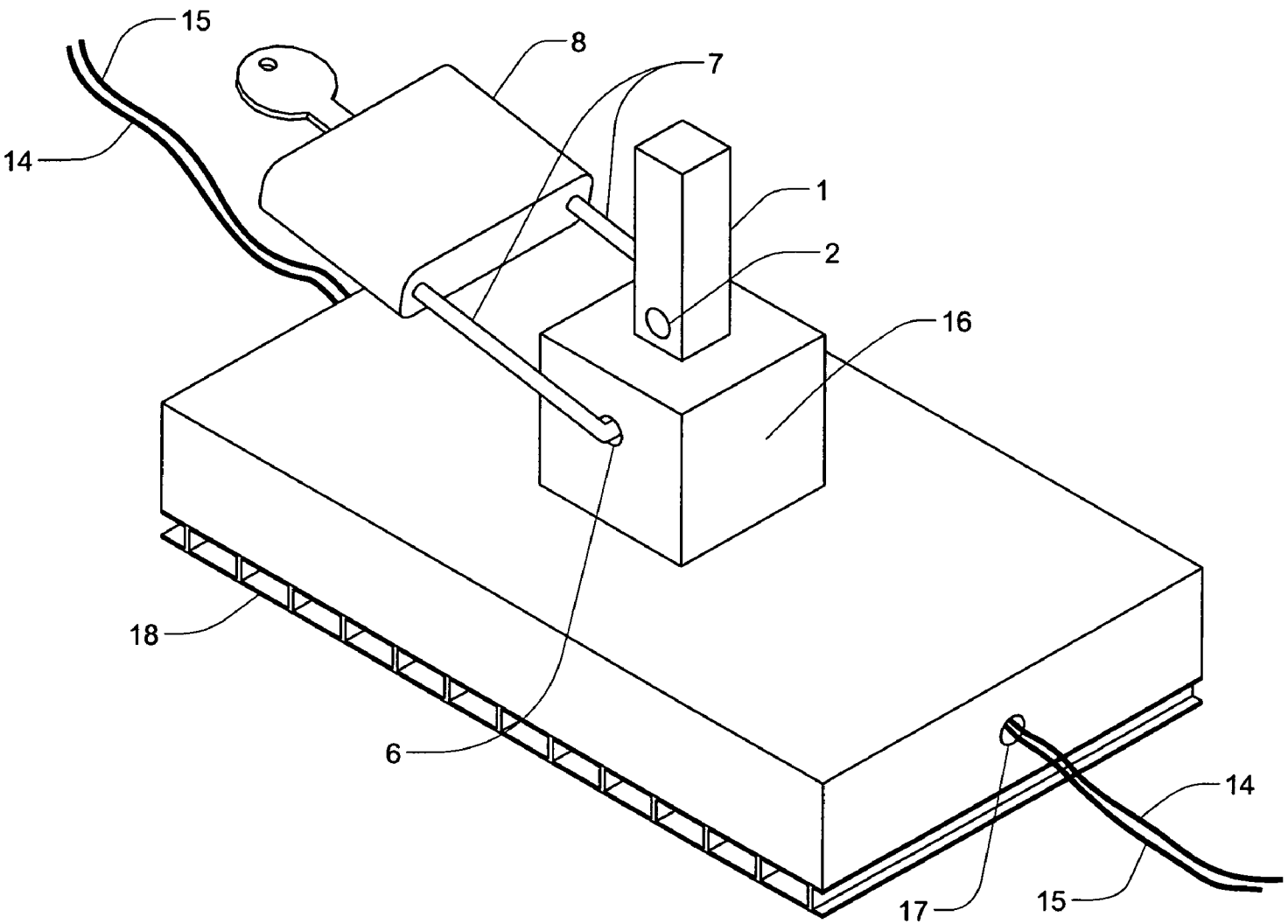
FIG. 3 is a picture of the whole invention with a padlock attached.

FIG. 3 is a picture of the whole invention, with a padlock attached. The casing 5 has a housing/guide 16 for the toggle-handle 1 and a lock hole 6. Both ends of housing have holes 17 to allow entry of the power cable 14 and power cable 15 of the apparatus. The toggle-handle 1 housing/guide 16 encases part of the toggle-handle 1, with the rest exposed so that it can be moved up and down manually. In this figure, hole 3 of the toggle-handle 1 is lined up with lock hole 6 of the toggle-handle 1 housing/guide 16, and the lock-bar 7 of the lock 8 is passing through the two of them, locking the device in the "off" configuration. For locking in the "on" configuration, the toggle-handle 1 would be moved downward, so that the upper hole 2 of the toggle-handle 1 would be aligned with hole 6.

The lock 8 can be a separate pad lock or combination lock or other lock with a lock bar that can pass through hole 6 and either hole 2 or hole 3; alternatively, it can be integrated into the device.

The switch itself consists of a toggle-contactor 4 and hinge 10, a contact 11, a non-conducting toggle-handle 1 with the hole 2 and hole 3 and a non-conducting, rigid connector 9, two wire-fasteners 12 and 13, and a non-conducting base-plate 18 to which the pieces are rigidly attached. In practice, the switch can be any standard electrical switch. The switch creates a drawbridge across the gap spanning the toggle-contactor 4 and the contact 11. The switch is in a closed position when the toggle-contactor/hinge connects the two and it allows electrical current to flow between them. The switch also has an open position, in which the toggle-contactor 4 does not touch its contact 11, which prevents electrical current from flowing between them.

The invention could be sold as a kit that could be installed into existing electrical circuit. The preferred embodiment envisions a kit that can be installed into a power cord of a common electrical apparatus. The kit would allow the user to separate the housing 5 from the base-plate 18 by means of several screws. The two wire-fasteners are attached to the base-plate 18 in such a manner that each fastener 12 or fastener 13 allows attachment of a wire. A preferred embodiment envisions the contacts as screws or clips. A person skilled in the art will see that many different types of fasteners could be used. The user would cut one of the two wires 14 of the power cord into two parts, and then expose the end of each piece by stripping a small portion of the insulation on the wire. Each end of the wire would then be attached to a wire-fastener. The other power wire of the apparatus would be left intact. The user would then replace and secure the base 18 to the housing 5 with screws, with the power wires of the apparatus passing through the holes 17 in the housing; the user could then operate the invention to both disrupt and restore power to the electrical apparatus, and also use the lock 8 and lock-bar 7 to fix the switch in an open or closed position.

Common power cords comprise two wires 14 and 15. Only one wire 14 need be cut to install the invention. The other wire 15 completes the larger circuit. A preferred example is the power cord to a television. Other possible uses include computers, DVD players, VCRs, power tools, ovens, stoves, electric heaters and electric fire simulators.

The purpose of the invention is to create an universal means for a user to control the function of an electric apparatus without the use of complex technology. This control relies on a mechanical or electronic means that is not subject to electrical failures or computer hacking. The mechanical means that is used is the lock bar 7. This lock bar 7 is a bar of durable material that cannot be broken by human strength. Some version of the lock bar 7 cannot be broken or cut by common tools. The lock bar 7 can be any shape or size, so long as it can fit into the first hole 2 and the second hole 3 in the toggle-handle 1 and into the hole 6 in the housing 5 and 16. A lock 8 immobilizes the lock bar 7. This lock 8 can be any kind of lock; it can be part of the housing 5 or it can be a separate lock.

The lock 8 can be any locking means. The lock 8 can be a lock controlled by a key or a combination. Alternatively, the lock 8 can be electrically powered and/or controlled by a computer or other human-controlled instrument. The type of lock 8 is not material to the invention. The preferred embodiment envisions a padlock as the lock 8 that can immobilize lock bar 7. Whatever the type of lock that lock 8 is, it must be able to immobilize the lock bar 7, or whatever else is physically affecting the characteristic of locking in either an "open-" or a "closed-switch" configuration.

Although this invention has been illustrated by reference to specific embodiments, it will be apparent to those skilled in the art that various changes and modification may be made which clearly fall within the scope of the invention. The invention is intended to be protected broadly within the spirit and scope of the appended claims.

What is claimed is:

1. An electrical switch device comprising:

an electrical switch with an open position and a closed position;

a toggle-handle attached to the electrical switch so that the toggle-handle could move the electrical switch between the open position and the closed position and maintain the electrical switch in that position;

at least two holes in the toggle-handle;

a lock bar;

a locking means to lock the lock bar and prevent movement of the lock bar;

a housing for the electrical switch and the toggle-handle with at least one hole in the housing that substantially lines up with at least one hole on the toggle;

so that the lock bar is attached to the electrical switch device by fitting the lock bar into both a hole in the housing and a hole in the toggle-handle and the locking means immobilizes the lock bar and thus the toggle-contactor and thus fixing the electrical switch in either an open or closed position.

2. An electrical switch device of claim 1 where the locking means is a padlock.

3. An electrical switch device of claim 1 where the locking means is a combination lock.

4. An electrical switch device of claim 1 where the locking means is integrated into the housing.

5. An electrical switch device of claim 1 where the locking means is controlled by a key.

6. An electrical switch device of claim 1 where the locking means is controlled by an electronic device.

7. An electrical switch device of claim 1 where the locking means is controlled by a computer.

8. An electrical switch device of claim 1 where the toggle-contactor has an open position hole and a closed position hole, so that when the lock bar is in the open position hole, the electrical switch is immobilized in the open, or "off", position and when the lock bar is in the closed, or "on", position hole, the electrical switch is immobilized in the closed position.

9. An electrical switch device of claim 1 where the open position of the electrical switch results in a break in the circuit and the end of the electrical flow in the circuit.

10. An electrical switch device of claim 1 used to prevent the operation of a television.

11. An electrical switch device of claim 1 used to prevent the operation of an electrical device.

12. An electrical switch device of claim 1 used to prevent the operation of a power tool.

13. An electrical switch device of claim 1 used in a kit where a user inserts a lock with a lock bar into at least one hole in housing and at least one hole in the toggle to immobilize the electrical switch.

14. An electrical switch device of claim 1 where the locking means is controlled by a keypad.

15. An electrical switch device of claim 1 where the locking means is controlled by a radio.

16. An electrical switch device of claim 1 where the locking means is controlled by a specific sound.

17. An electrical switch device of claim 1 where the locking means is controlled by an ultrasound pattern.

18. An electrical switch device of claim 1 where the locking means is controlled by an optical device.

19. An electrical switch device of claim 1 where the locking means is controlled by an ultraviolet device.

20. An electrical switch device of claim 1 where the locking means is controlled by a infrared device.

21. An electrical switch device kit comprising:

an electrical switch with an open position and a closed position and with two wire-connectors;

a toggle-handle attached to the electrical switch to that the toggle-handle could move the switch between the open position and the closed position, with at least two holes in the toggle-handle;

a lock bar;

a locking means to lock the lock bar and prevent movement of the lock bar;

a housing for the electrical switch and the toggle with at least one hole in the housing that substantially lines up with at least one hole on the toggle-handle;

an electrical wire of an electrical circuit;

so that the electrical wire of the electrical circuit can be cut and stripped of insulation such that one of the newly-created wire-ends can be electrically attached to one wire-fastener of the electrical switch and the other wire-end attached to the other wire-fastener of the electrical switch, so that when the electrical switch is in a closed position, electricity can flow in the electrical circuit;

so that the lock bar is attached to the electrical switch device by fitting the lock bar into both a hole in the housing and a hole in the toggle-handle and the locking means immobilizes the lock bar and thus the toggle-contactor and thus fixing the electrical switch in either an open or closed position.

* * * * *